United States Patent [19]

Mains et al.

[11] 4,384,821

[45] May 24, 1983

[54] FREE FLOATING DIVIDER WALL TURBINE HOUSING

[75] Inventors: Arthur H. Mains, Indianapolis; Wilbur A. Spraker, Jr., Martinsville; Allan C. Harper, Indianapolis, all of Ind.

[73] Assignee: Wallace Murray Corporation, New York, N.Y.

[21] Appl. No.: 311,250

[22] Filed: Oct. 14, 1981

[51] Int. Cl.[3] ..... F01D 25/26

[52] U.S. Cl. ..... 415/136; 415/184

[58] Field of Search ..... 415/134, 135, 136, 184, 415/187, 188, 189, 190

[56] References Cited

U.S. PATENT DOCUMENTS 3,270,495 9/1966 Connor .

FOREIGN PATENT DOCUMENTS 53-71711 6/1978 Japan ..... 415/184

*Primary Examiner*—Philip R. Coe
*Assistant Examiner*—Shewen Bian
*Attorney, Agent, or Firm*—Thomas J. Greer, Jr.

[57] ABSTRACT

A turbocharger construction of the divided turbine housing type. To prevent failure of the divider wall due to thermally induced stresses, the divider wall is separate from the housing and means are provided to enable at least the major portion of the divider wall to move radially with respect to the housing.

7 Claims, 3 Drawing Figures

10
12
14
16
18
20
22
24
28
29
30
33
34
34'
36
38
40
42
44
46
47
48
50
60
62
64
66

FREE FLOATING DIVIDER WALL TURBINE HOUSING

This invention relates to turbochargers and more particularly to a housing construction for the turbine portion of a turbocharger.

Turbochargers are energy saving devices for internal combustion engines, particularly diesel engines for trucks, tractors and the like. A turbocharger may be considered as a combination turbine and compressor, with the turbine and compressor wheels coupled or joined together by a common shaft. The exhaust gases from an internal combustion engine are fed to the turbine wheel. The gases pass through the turbine wheel, allowing extraction of energy from the gases, by the wheel and causing it to rotate. The gases then pass out to exhaust. The compressor wheel compresses ambient air and feeds it, to the intake of the engine. A turbocharger is accordingly a device for forcing at elevated pressure (boost) the air or fuel-air mixture into an internal combustion engine, the turbocharger employing the energy (to turn the turbine wheel) in otherwise spent exhaust gases. In distinction to the well known supercharger which derives power for the compressor wheel directly from the crankshaft of the engine, the turbocharger derives its power from the energy in the exhaust gases.

The present invention relates to an improvement in the housing of the turbine portion of a turbocharger. In certain applications, it has been found convenient to divide the torus or donut-shaped chamber within the turbine housing into two portions, these two portions being defined by a radially extending, circular divider wall and the remainder of the housing. The divider wall extends from an outermost portion of the housing and thence radially inwardly towards the annular throat through which the exhaust gases pass to the turbine wheel. The turbine is usually of the radial inflow type. Examples of such a housing construction are shown in U.S. Pat. Nos. 3,270,495 of Sept. 6, 1966 issued to Connor and 3,292,364 of Dec. 20, 1966 issued to Cazier.

In a typical divided housing type turbocharger construction, as exemplified in these two U.S. patents, the housing for the turbine portion of the turbocharger as well as the radially extending divider wall are integrally formed, as from cast iron. During operation of the turbocharger, the hot exhaust gases coming into the turbocharger from the cylinders of the internal combustion engine enter one or both of the two chambers in the turbine portion of the housing. These gases are very hot and accordingly cause changes in the size of the housing, these changes being due to the usual effect of thermal expansion of metal attendant to an increase in temperature. Both the divider wall and the housing tend to expand radially with increasing temperature. However, the divider wall reaches higher temperatures than does the housing, because the divider is exposed to the hot gases on both surfaces while one surface of the housing wall is exposed to cooler, ambient air. Because of this temperature difference, the unconstrained thermal expansion of the divider would be greater than that of the housing in the radial direction. The lesser expansion of the housing constrains the thermal expansion of the divider wall, thus inducing undesirable thermal stresses in the divider wall. Furthermore, the shape of the divided turbine housing is self-constraining in that changes in temperature produce thermal stresses even in the absence of temperature gradients, thus increasing the overall stress levels. It has been found that these stresses have resulted in failure or cracking of the divider wall with subsequent breakdown of the turbocharger.

According to the practice of this invention, the problem of differential radial expansion is overcome. To accomplish this, the turbocharger housing and divider wall in one embodiment of the invention are made separate, with the radially outermost periphery of the divider wall extending into a groove located in the adjacent portion of the turbine housing chamber. A radial clearance is provided between the radially outermost portion of the divider wall and the radially outermost portion of the groove into which the periphery of the divider wall extends and is situated. By virtue of this construction, the divider wall may radially expand, sliding within the groove radially outwardly at its outermost periphery during operation, and causes no stresses on the housing, such radial movement being relatively unobstructed. Accordingly , thermally induced stresses in the divider wall are avoided. The radially outermost periphery of the divider wall is preferably fluted or serrated so as to produce axially offset segments, angularly alternating, with the segments being biased normally away from each other in an axial direction to thereby provide a centering or positioning action between the housing and the divider wall. For ease in assembly, the housing is made of two portions, with one portion provided with a continuous annular notch so that when the two portions are joined, an annularly continuous groove is defined. Preferably, the divider wall is formed of a heat resistant material such as stainless steel that may exhibit a higher thermal coefficient of expansion than the cast iron from which the remainder of the housing is formed.

According to another modification of the invention the divider plate outermost radius is the same as the outermost radius of the housing groove which receives it, the divider plate being formed with an annularly continuous expansion joint. In this second construction, the outward expansion of the major portion of the circular divider wall is accommodated by the expansion joint, with only the expansion of the outermost rim portion of the divider wall forcing radially outwardly against the turbine housing.

IN THE DRAWINGS

Figures 1, 2, 3:
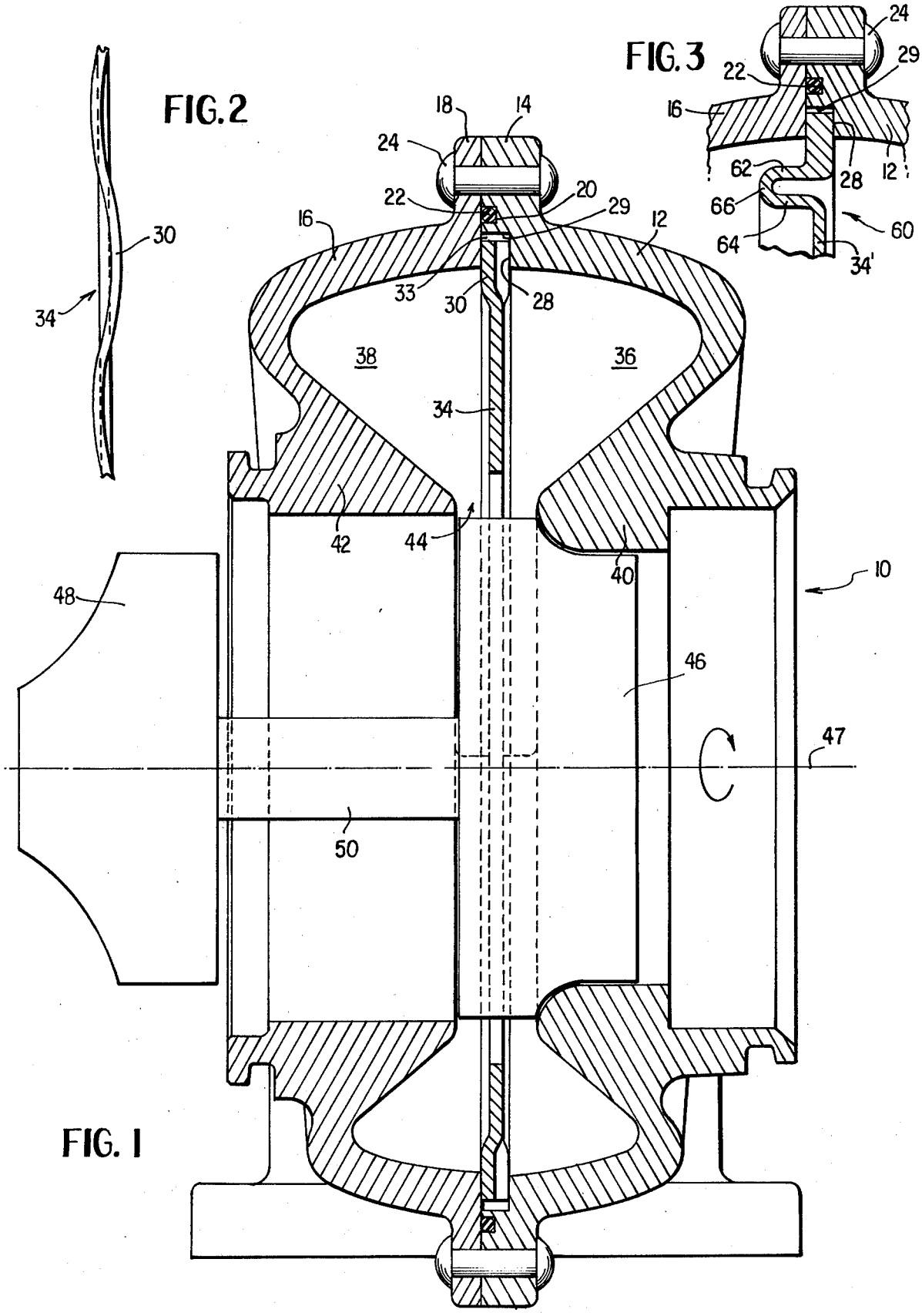
FIG. 1 is a longitudinal cross-sectional view of a turbocharger turbine housing portion constructed in accordance with this invention, the view also showing the location of the usual turbine wheel and compressor wheel associated with the housing.
FIG. 2 is an edge view of the divider wall of FIG. 1.
FIG. 3 is a partial view, similar to FIG. 1, and illustrates a modification.

Referring now to the drawings, the numeral 10 denotes generally a housing for the turbine part of a turbocharger. The housing is annularly continuous and is defined by a first half section or portion 12 having a plurality of angularly spaced lugs 14 integral therewith. The numeral 16 denotes a complementary housing half or section also having a plurality of angularly spaced lugs 18 which, upon assembly of the housing halves, match with lugs 14. The numeral 20 denotes an annularly continuous groove into which fits an annularly continuous seal 22, formed for example of wire. The numeral 24 denotes a rivet or bolt for fastening complementary lugs 14 and 18. Other means of joining the halves (parts 12 and 16) such as welding, could be used. The numeral 28 denotes a radially extending cut on one face of the outer flange portion of housing half 12, while the numeral 29 denotes an axially extending circular wall portion extending to the face of the flange portion of housing 12 from cut 28.

The numeral 30 denotes any one of a series of circumferentially extending, axially offset segments located at the periphery of a circular, disk-shaped divider wall, the divider wall being denoted by the numeral 34. The circular wall 34 is centrally apertured, so as to accommodate the turbine wheel 46. The numeral 33 denotes a radially extending clearance or distance between the radially outermost portion of wall 34 (having segments 30) and axially extending wall portion 29.

The numeral 36 denotes one annularly continuous turbine chamber, while the numeral 38 denotes a second annularly continuous turbine chamber, these two chambers defined by the divider wall 34 extending radially inwardly into the housing 12, 16. The numeral 40 denotes a radially innermost portion of housing half 12, while numeral 42 denotes a corresponding radially innermost housing portion 42 of the left housing half 16. A throat 44 is defined as the radially innermost portion of the chambers 36, 38 at the region adjacent 40, 42. The numeral 46 denotes a conventional turbine wheel rotating about an axis 47, the turbine wheel turning compressor wheel 48, both turbine wheel 46 and compressor wheel 48 being mounted on common shaft 50. The mode of operation is as follows.

Hot exhaust gases are fed by suitable ducting within the turbocharger (not illustrated) into one of both of annular chambers 36 and 38. The gases pass radially inwardly, through throat 44 and onto the periphery of turbine wheel 46. They then pass along and between the blades of the turbine wheel and then exit in a generally axial direction for subsequent exhaust. Rotation of turbine wheel 46 causes rotation of compressor wheel 48 to thereby compress ambient air for subsequent passage of an air or air-fuel mixture for the internal combustion engine. The remaining portions, such as the compressor housing, of the turbocharger are not shown since they form no part of this invention and are well known in this art.

During operation, the divider wall 34 will expand radially a greater extent than the radial expansion of turbine housing portions 12 and 16. By virtue of clearance 33, the outer periphery of the divider wall can move radially outwardly without being constrained, to thereby avoid mechanical stresses which would otherwise form in the divider wall were its outer periphery not free to move radially outwardly. Such lack of freedom of radially outward movement has been a characteristic of prior divider wall turbine housing constructions and has led, as noted above, to failures in the wall.

The function of the alternate axially opposite segments is three-fold. First, the segments allow better groove width tolerances since their effective width is more easily controlled than the sheet metal stock thickness. Second, the segments only offer line contact with the castings so that friction between the divider wall and cast pieces can be controlled. Third, the serpentine shape of the segments allows a controlled axial preload to be established for divider wall locating purposes, i.e., the segments function as a wave washer spring so that the installed preload can be minimized.

Referring now to FIG. 2 of the drawings, an end view illustrates the fluted or pleated configuration of the outermost periphery of the circular divider wall 34. It is seen that the periphery 30 assumes a serpentine or undulating configuration.

As a specific example of the invention, the divider wall 34 is formed of AISI 321 Austenitic stainless steel, with housing halves 12 and 16 formed of machined modular iron.

Referring now to FIG. 3 of the drawings, a modification is illustrated of the divider wall 34. In this embodiment, the outer periphery of the divider wall may also be fluted or otherwise deformed to allow for differences in thermal expansion. The reader will observe that no clearance, such as clearance 33 of the embodiment of FIG. 1, is required. In this embodiment, radial movement of the major portion of the disc 34', similar to disc 34, relative to the housing is made possible by an annularly continuous expansion joint defined by a groove 60 in the disc. Groove 60 is defined by axially extending portions 62 and 64 and radially extending portion 66. The reader will understand that the groove is of continuous annular or circumferential extent and is preferably located near the outermost radial portion of divider wall 34'. The expasion section 60 may be formed by stamping the disc which defines divider wall 34'. The reader will now be in a position to readily visualize that radial expansion of the divider wall 34', as caused by elevated temperatures, will result in a distortion of the expansion joint 60. By virtue of expansion joint 60, radial forces attendant elevated temperatures will result in a distortion of expansion joint 60 as opposed to the building up of undesirably high stresses in the divider wall 34'. Expansion of those disc portions radially inwardly of expansion joint 60 will be taken up by the expansion joint. Radial expansion of the disc radially beyond the expansion joint will result in stresses in that portion, but such stresses, being lower, will not cause failure. In FIG. 3, the rim of divider wall 34' is shown as spaced from groove wall 29, and thickner than the remainder of the disc for clarity of illustration.

We claim:

1. A turbocharger construction of the divided turbine housing type, including first and second annular turbine chambers for receiving hot gases, said chambers positioned within an annular housing, a turbine wheel postioned radially inwardly of said annular chambers, the radially innermost portion of said housing having an annular throat, the turbine wheel positioned radially inwardly of the throat and receiving hot gases passing radially inwardly from the two annular chambers through the throat to thereby rotate the turbine wheel, the turbine wheel coupled to a compressor wheel axially spaced therefrom, the compressor wheel adapted to compress air, the first and second annular chambers defined by an angularly continuous divider wall passing from the radially outermost portion of the housing towards the said throat, the improvement comprising, (1) the divider wall being separable from the housing, the radially outermost periphery of the divider wall being received in an annularly continuous groove in the housing, (2) means for allowing at least the major portion of the divider wall to undergo radial movement relative to the housing, (3) whereby radial expansion of the divider wall, caused by elevated temperatures, may take place substantially independently of changes in the size of the housing caused by such elevated temperatures.

2. The turbocharger construction of claim 1 wherein the housing is defined by two annularly continuous housing halves, one of said housing halves having at least a portion of said annularly continuous groove therein.

3. The turbocharger construction of claim 1 or 2 wherein said means is defined by a radial clearance between the radially outermost periphery of said divider wall and the radially outermost periphery of said groove.

4. The turbocharger of claim 3 wherein the radially outermost periphery of the divider wall is provided with adjacent axially opposite offset segments, said segments alternately contacting opposite axial sides of said groove.

5. The turbocharger construction of claim 3 wherein the materials of construction of said housing and of said divider wall have different coefficients of thermal expansion.

6. The turbocharger of claim 1 or 2 wherein said means is defined by an angularly continuous expansion joint formed integrally with the divider wall and being radially located nearer to the housing than to the radially innermost portion of the divider wall.

7. The turbocharger construction of claim 6 wherein the materials of construction of said housing and of said divided wall have different co-efficients of thermal expansion.

* * * * *